United States Patent [19]

Moll

[11] Patent Number: 4,541,592

[45] Date of Patent: Sep. 17, 1985

[54] WING-STABILIZED PROJECTILE

[75] Inventor: Manfred Moll, Duesseldorf, Fed. Rep. of Germany

[73] Assignee: Rheinmetall GmbH., Duesseldorf, Fed. Rep. of Germany

[21] Appl. No.: 440,631

[22] Filed: Nov. 10, 1982

[30] Foreign Application Priority Data

Nov. 10, 1981 [DE] Fed. Rep. of Germany ..... 3144532

[51] Int. Cl.[4] ..... F41G 7/00; F42B 15/02

[52] U.S. Cl. ..... 244/3.22

[58] Field of Search ..... 60/228, 229; 137/883, 137/885; 244/3.22

[56] References Cited

U.S. PATENT DOCUMENTS

| | | | |
|---|---|---|---|
| 2,613,497 | 10/1952 | MacDonald | 60/229 |
| 3,015,210 | 1/1962 | Williamson . | |
| 3,069,846 | 12/1962 | Buescher . | |
| 3,091,084 | 5/1963 | Eckhardt . | |
| 3,139,725 | 7/1964 | Webb . | |
| 3,599,899 | 6/1969 | McCullough . | |
| 3,721,402 | 3/1973 | Holland | 244/3.22 |
| 4,017,040 | 4/1977 | Dillinger et al. | 244/3.22 |
| 4,078,495 | 3/1978 | Ledden, Jr. | 244/3.22 |
| 4,413,795 | 11/1983 | Ryan | 244/3.22 |

FOREIGN PATENT DOCUMENTS 1264312 5/1961 France .

978029 12/1964 United Kingdom .

*Primary Examiner*—Charles T. Jordan

[57] ABSTRACT

The invention relates to a wing-stabilized projectile having a transverse thrust steering arrangement. The transverse thrust steering arrangement is constructed in such a way that the release of thrust impulses out of control nozzles is achieved, independently from each other and oscillation free, whereby an excess pressure in the drive system of the transverse thrust steering mechanism is avoided.

This is achieved in that in a control block there is provided at least one movable sealing member which is connected with a signal converter as well as with a control conduit having a centrally arranged sealing member, whereby by unloading the end surface of the sealing member it is opened and permits the outstreaming of generator gases which form a radial thrust impulse F via a control nozzle effecting a flight correction. The pressure loading of the end surface of the sealing member produces a closing process of the closing member at the end of the flight correction whereby the prior closed control member which is centrally mounted in the control block is pressure-unloaded via a throttle, so that the generator gas can be drawn off via of feed conduit and a draw-off conduit in a momentum-free manner.

14 Claims, 9 Drawing Figures

WING-STABILIZED PROJECTILE

BACKGROUND OF THE INVENTION

Guided projectiles having a mechanically controlled steering mechanism which emits lateral controlled impulses that are produced by means of uniformly streaming generator gases form part of the prior art. For this purpose a gas distribution arrangement, consisting of a triangular shaped vane, is provided which is pivotally supported about an axis normal to the longitudinal projectile axis and serves to separate the gaseous streams and guide them through two outlets. Such known projectile is, for example, disclosed in U.S. Pat. No. 4,211,378. In a further embodiment of such a missile type of projectile the gaseous stream is distributed via four outlet openings, of substantially square cross-section, which expand outwardly and which are disposed within a truncated conically-shaped distribution tongue which is pivotally mounted on a ball and socket support. By appropriate pivoting of the tongue a correction of the flight path is obtained by the gases streaming through the passages of the tongue. The drawback of the afore-described steering arrangement resides in that it is of bulky construction and has a particular large dead weight which is disadvantageous in view of the mechanical actuation of the control mechanism. Moreover, a continuous oscillating post-adjustment is required for controlling the flight path of the projectile whereby, at simultaneous out-streaming of the gases through a plurality of outlet nozzles, only a portion of the energy becomes effective as a steering impulse. A further drawback of such a prior art steering arrangement resides in the fact that it includes a construction formed by a plurality of complex elements which are easily movable, are arranged one behind the other, and occupy a large space which causes such elements to frequently malfunction. This particularly manifests itself due to the high mass moment of inertia forces which acts on the projectile during the firing thereof. Despite the fact that intermittently ignited steering arrangements are known in the art which can deflect the thrust normal to the direction of flight, such as for example for guiding rockets or position stabilization, flight path correction and correction of satellite flight path, such known devices have been found unsuitable for guiding of projectiles fired from gun barrels due to spatial and weight considerations. Due to the high initial acceleration at firing from a gun barrel there are imparted very high loads on the projectile which create in any event significant operational problems.

SUMMARY OF THE INVENTION

It is an object of this invention to provide a transverse thrust control arrangement for a projectile of the afore-described type in which the rendering of thrust impulses through control nozzles is attained, independently from each other and oscillation-free while simultaneously avoiding an excess pressure in the drive system for the transverse thrust steering. Thereby there is simultaneously attained a space-and weight-saving, yet a rugged construction is provided which can withstand the high loads that occur during firing from a gun barrel.

The steering arrangement of this invention makes possible to achieve a flight-end-phase, by constantly drawing off generator gases used for steering, preferably by independently controlling the sequentially timed steering impulses, which can be used for steering the thrust mass which is available; magnet-nozzles transform momentarily the steering command for further transmission to the coaxially disposed sealing members. However, when the coaxially disposed sealing members are in a closed position a direct reversal of the generator gases onto a centrally disposed sealing member results automatically.

According to a special feature of the inventive arrangement the axial and axially parallel arranged sealing members are movably arranged in the axial direction without impairment in such a way, that the moment of inertia forces which occur during firing from a gun barrel are received on the seating surfaces of the cylinder inserts, arranged in the flight direction.

According to a preferred embodiment a coaxially arranged sealing member is closed by means of a momentarily reacting electromagnetically actuated junction nozzle, by means of cold air, whereby via the cold air transport and the thereby attained heat drawing off the rigidity and creep strength of the sealing ring at the periphery of the sealing element is increased.

Furthermore, when the sealing element for the control nozzle is closed a direct controlling of the centrally positioned sealing element is provided, whereby it is made possible that the impulse of the out-streaming generator gas can be released in a momentum-free manner. In such an arrangement the generator gas feed and generator gas outlet conduits with their forward connections facing away with respect to the flight direction make for a load bearing, spatial and weight-saving construction which is quite capable to withstand acceleration forces.

In accordance with a further feature of the invention it is advantageous with small projectile diameters or for reasons of particularly high flight velocity or short flight time, that with rolling flight-stabilized projectiles only a one thrust-nozzle and a coaxially arranged closing element is activated for the flight correction, whereas with position-stabilized projectiles, depending on the spatial possibilities and the consumption limited by the size thereof, the projectile can be provided with thrust nozzles having coaxially arranged closing elements in different numbers.

BRIEF DESCRIPTION OF THE DRAWINGS

With these and other objects, which will become apparent in the following detailed description in which non-inventive details have not been illustrated, the present invention, which is shown by example only, will be clearly understood in connection with the accompanying drawings, in which.

DESCRIPTION OF PREFERRED EMBODIMENTS

Figure 1:
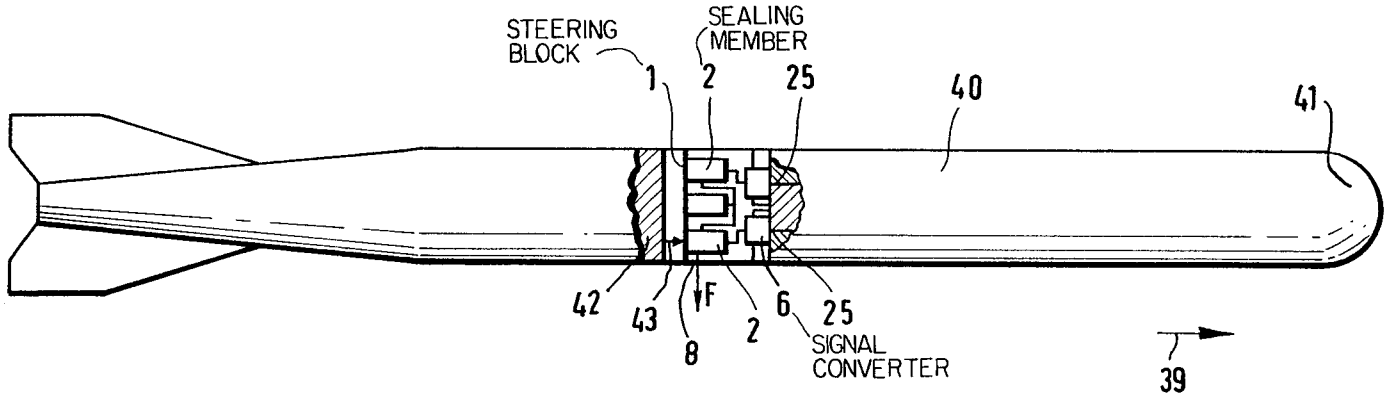
FIG. 1 is a side-elevational view of a wing-stabilized projectile, wherein the transverse thrust steering arrangement in accordance with the invention is shown in cross-section.

In FIG. 1 there is illustrated a wing-stabilized projectile 40 which includes a transverse thrust steering arrangement having a steering block 1. There are disposed, for example, within the steering block 1 three sealing members 2 which function so that a gas generator 42 disposed within the projectile is adapted to produce a gaseous stream in such a way that it permits the outflow of a gaseous stream via the steering nozzle 8. By actuating a direction-controlling electrical pulse a thrust impulse F is produced which effects the flight correction. Signal converters 6 are provided for converting the control signals which are received at their input 25 and effect the release of the sealing members 2. The control block 1 is mounted in such a way in the projectile 40 that the direction 43 of the gaseous stream acts in the flight direction 39 on the opened sealing member 2. After the generator gas pressure has formed the sealing member 2 is axially opened in the flight direction by unloading the sealing member 2 and fixing the streaming energy.

Figure 2:
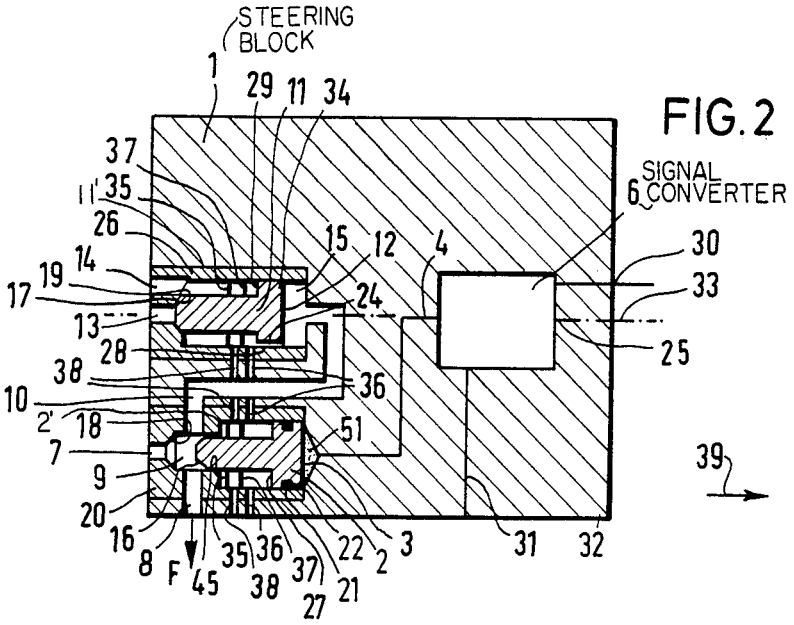
FIG. 2 is a schematic cross-sectional view of a transverse thrust steering arrangement including a steering nozzle.

FIG. 2 illustrates (and FIG. 7 at an enlarged scale) the control block 1 with only one sealing member 2 shown, which is mounted on a circle (see FIG. 4, where four sealing members 2 are equidistantly disposed on a circle 48) which is coaxial with the longitudinal projectile axis. The sealing member 2 is shown in the opened position 9. When the sealing member 2 is in this opened position 9, there is established a flow passage between the generator gas feed conduit 7 and the control nozzle 8; a flow passage is also formed between the steering conduit 10 and the piston chamber 15 of the axially movably mounted sealing member 11. The sealing member 2 acts thereby as a differential piston, which can be loaded at its front face 3, via a control conduit 4 by means of a signal converter 6 advantageously using cold air as a pressure medium 51 and as a cooling medium which can be introduced into the projectile. The axial end of the sealing member 2 which confronts the generator gas feed conduit 7 serves as a sealing surface 16 which mates with the seat 18 of the cylinder insert 20 and which, when the sealing member 2 is in the open position 9, is disposed within the periphery of the small differential surface in the conduit 45 of the cylinder insert 20. The control nozzle 8, which is radially disposed with respect to the outer periphery of the control block 1, has as does the generated gas seat conduits 7 and 13, as well as the generator gas drawing off conduit 14 such sized and dimensioned circular cross-sections, that a constant pressure remains available in the gas generator 42. The pressure of the outflowing generator gases is measured in such a way that, via the control conduit 10, the surface 12 is pressure loaded during the control impulse release, and the centrally arranged sealing member 11 is positioned in the closed position. When the sealing member 2 is closed there is provided a pressure release and exchange in the piston chamber 15 via a throttle opening 24 by means of a moment-free outstreaming via conduits 36, whereby a communication of these conduits 36 via the sealing member 2 to the exterior side of the control block 1 is formed; and via the same conduits 36 also during the closing process the piston chamber volume, formed by means of the piston face 27, is vented to the exterior.

By opening the sealing member 11 a uniform outstreaming of the generator gases via the outlet conduit 14 is possible. This arrangement provides that the gaseous stream impulse can be drawn off in a momentum-free manner. For sealing off the arrangement with respect to the hot generator gases, there are provided seals 35, 37 whose trailing volume can be drawn off by means of the conduits 38 without pressure loss.

The sealing member 11 also functions as a sort of differential piston, whereby in its closed position the force which has been transferred by the generator gas on the pressure-loaded end face within the seating surface 17 is not capable to open the sealing member against the force of the pressure loaded surface 12.

If there is only one sealing member 2 mounted in the control block 1, in accordance with the embodiment of FIG. 2, there is also only provided one feed conduit 30 and one outlet conduit 31 for the pressure medium control. For compensation a space in the control block 1, disposed at the side of the sealing member 2 radially opposite thereof, is available as further control means for the projectile.

Figure 3:
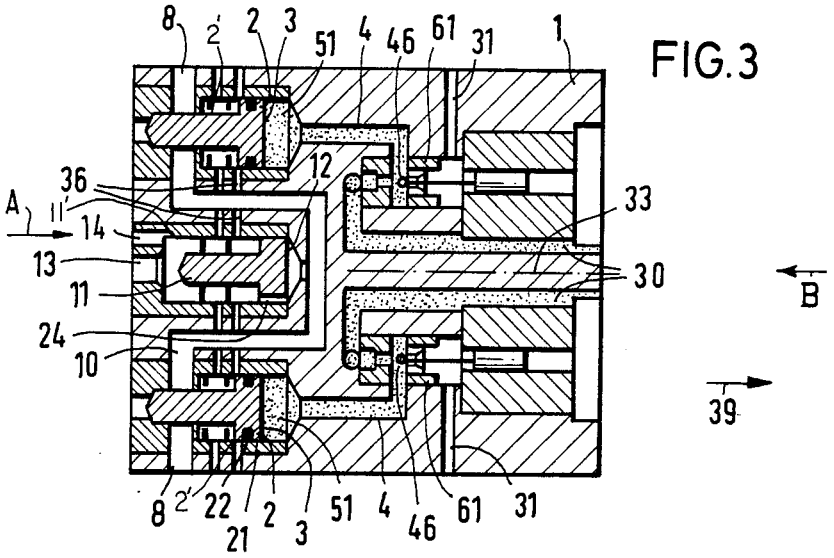
FIG. 3 is a schematic cross-sectional view along the plane 3—3 in FIG. 4 of a transverse thrust steering arrangement having four parallelly arranged steering members which are closed by means of pressurized air acting thereon.
Figure 4:
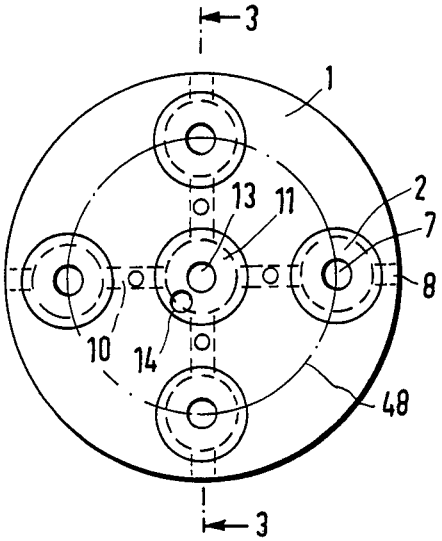
FIG. 4 illustrates the arrangement of the gas generator inlet and outlet openings, as well as the arrangement of the steering nozzles in the transverse thrust steering arrangement viewed in the direction of the arrow A in FIG. 3.

In FIG. 3 there is illustrated a control block 1 having a plurality of sealing members 2 equidistantly arranged and coaxial circle 48 (FIG. 4). Each sealing member 2 coacts with an electromagnetically actuated valve 61 which, when in the open position 46, permits the flow of the pressure medium 51, in the form of cold air, from the feed conduit 30 via the control conduit 4 for pressure loading the end surface 3 of the sealing member 2, to thereby move the sealing members 2 into their closed position. By moving the members 2 into their closed position the generator gas loading via the control conduit 10 onto the surface 12 of the centrally arranged sealing member 11 is interrupted, so that a pressure build-up via the throttle opening 24 and conduits 36 can result. Thereby the sealing member 11 is opened by means of the generator gas pressure that forms in the feed conduit 13 and the generator gas is drawn-off via the draw-off conduit 14 by avoiding an impermissible high excess pressure build-up. For the purpose that the sealing member 11, at the release of a control impulse via a random control nozzle 8, interrupts the gas stream, there is provided for each opened sealing member 2 a communication to the surface 12 via a control conduit 10, by the pressure loading of which the axial sealing process of the sealing member 11 is effected.

Thereby there is provided that one after the other each equidistantly arranged sealing member 2 is placed in a position to release radially directed flight path-correcting control impulses relative to the control block axis 33 which are excited by means of electromagnetic signal conversion, which lies in a time region of milliseconds.

Advantageously, this steering mechanism distinguishes itself, when a defect or stream loss occurs, in such a way that the projectile continues in flight without flight correction, because the pressurized air loading on the surface 3 of the sealing member 2 with opened conduit valve 61 is maintained and the generator gas continues to stream out via the central sealing member 11.

FIG. 4 illustrates the arrangement of four sealing members 2 arranged about a coaxially disposed circle 48 which sealing members have corresponding control nozzles 8, generator gas seat conduits 7, and an axial sealing member 11 with generator gas feed conduit 13 and draw-off conduit 12, as well as the course of the control conduit 10 in the control block 1.

Figure 5:
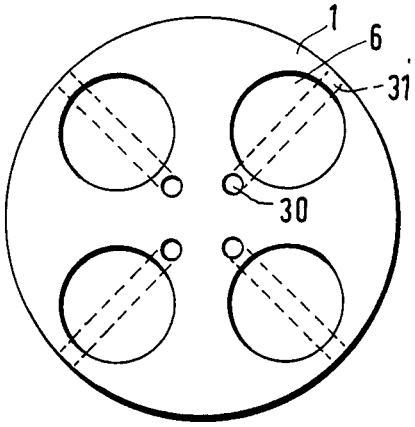
FIG. 5 illustrates the arrangement of the electromagnetically actuated path-valves disposed in the transverse thrust steering arrangement as viewed in the direction of arrow B in FIG. 3.

FIG. 5 illustrates the arrangement, for example, of four signal converters 6, whereby the pressurized air feed conduit 30 leading to the conduit valve 61 and the pressurized air outlet conduit 31 in the control block 1 are illustrated.

Figure 6:
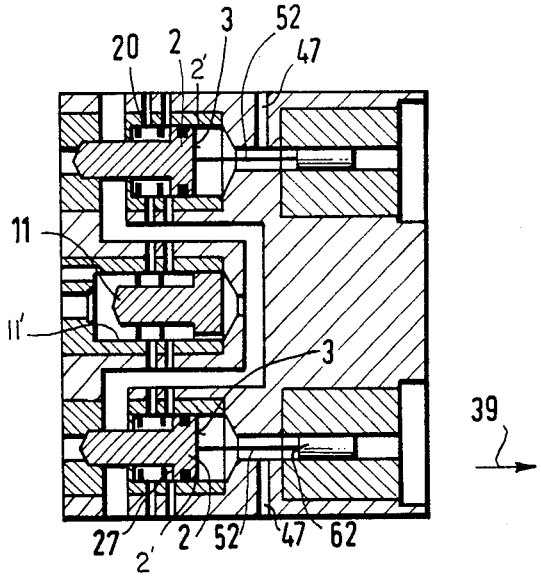
FIG. 6 is a schematic cross-sectional view of a transverse thrust steering arrangement having four parallelly arranged control members which are, however, in distinction to the arrangement of FIG. 3, directly actuated electromagnetically via plungers.

In a further embodiment of the inventive arrangement there is illustrated in FIG. 6, in contradistinction to the arrangement of FIG. 3, an electromagnetically actuated control mechanism for the sealing members 2 in plural arrangement in which sealing members are directly controlled via plungers 52. This embodiment distinguishes itself by means of a very reduced spatial requirement, whereby the same arrangement of the sealing members 2, 11 as is illustrated in FIGS. 2, 3 forms the basis of the arrangement. The sealing members can also be formed as a cylinder without a cylinder seat ring 20 which is, however, not illustrated in the drawing. The air volume which is moved by the surface 3 during the stroke of the sealing member 2 is sucked off by the conduit 47 and is expelled.

In the event a flight correction of the projectile 40 (FIG. 1) is to be effected the signal converter 6 receives an electrical command signal, whereby after conversion of the command signal in the signal converter 6 effects a release of one or a plurality of sealing members 2. The release of the sealing members 2 is effected in accordance with FIGS. 7 and 8 by opening a conduit valve 61 within the signal converter 6, whereby a communication of the control conduit 4 with the outlet conduit 31 is established and as a result the surface 3 of the sealing member 2 is no longer loaded by means of the pressure medium 51. The control adjustment of the sealing members can, according to FIG. 9, also be carried out via a plunger 52 which is actuated by means of an electromagnetic switching member 62, whereby the piston displacement of the air which is displaced by means of the surface 3 escapes via the conduit 47.

The generator gas is fed via a generator gas-feed conduit 7 onto the seating surface 16 which defines the end of the sealing member 2. The pressure engendered by the gases of the gas generator 42 serve for moving the sealing member 2 with its surface 3 to the right, as viewed in FIG. 9, so that the sealing member 2 displaces the required pressure medium 51 with its surface 3 or pushes back the plunger 52. The generator gas is in a position, under conditions of open position 9 of the sealing member 2, to stream back into the direction of the arrow 43 to the generator gas-supply conduit 7 whereby, on the one hand, it reaches the control conduit 10 and, on the other hand, it reaches the control nozzle 8. As a result of the control conduit 10 being in communication with the piston head 15 of the sealing member 11 the surface 12 can be pressure loaded with a generator gas and the sealing member 11, which functions as a differential piston, can be moved in the direction towards the generator gas-seat conduit 13 until the piston movement is stopped by means of the seating surface 19 and thereby the sealing member 11 blocks the escape of the generator gas-feed conduit 13 through which the generator gas escape streams via the escape conduit 14.

The generator gas is now only in a position to escape via the control nozzle 8 from the control block 1 to thereby produce a flight-correcting thrust impulse F in the radial direction.

Figure 7:
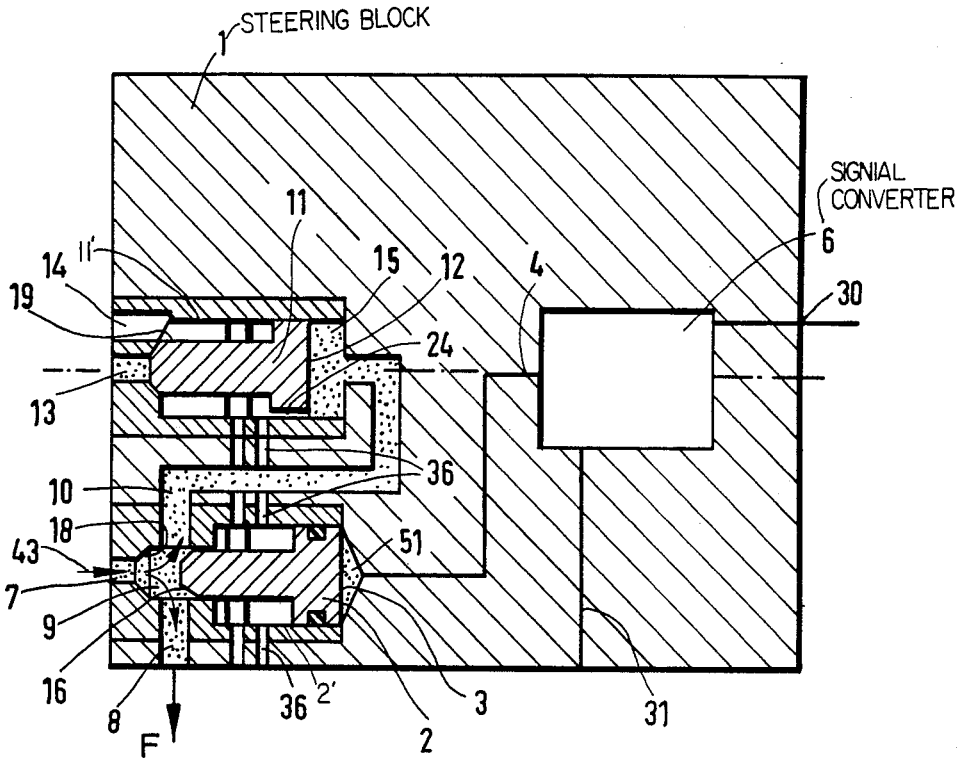
FIG. 7 is an enlarged view of FIG. 2 in which the various gas streams are illustrated by way of arrows during the control pulse transmission with opened control members.
Figure 8:
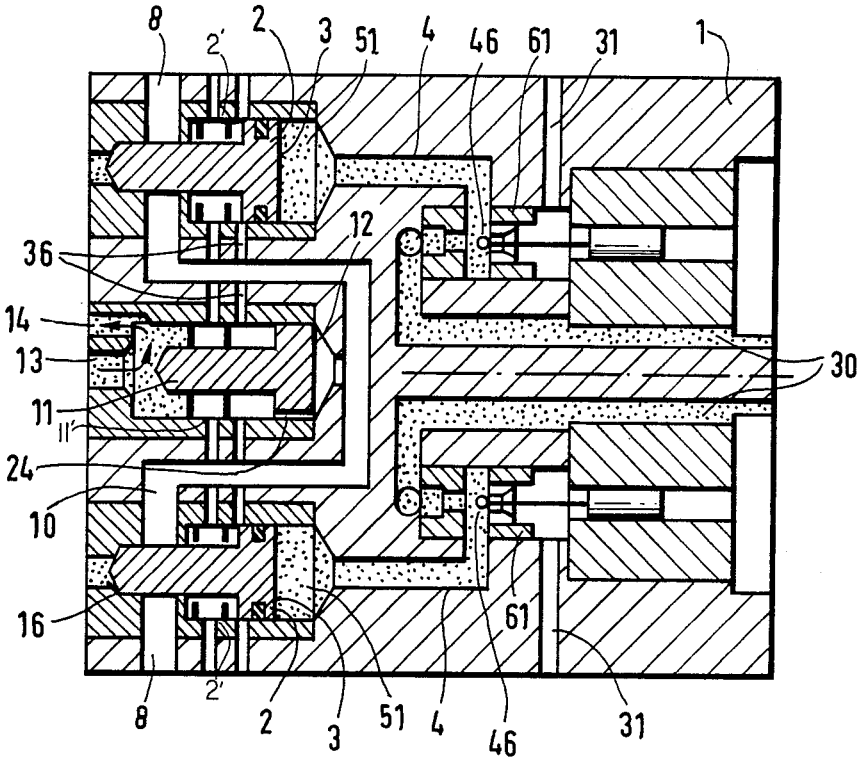
FIG. 8 is an enlarged view of FIG. 3 wherein the gas streamings of the generator gases during the straight flight with closed pressure-unloaded control members is illustrated.
Figure 9:
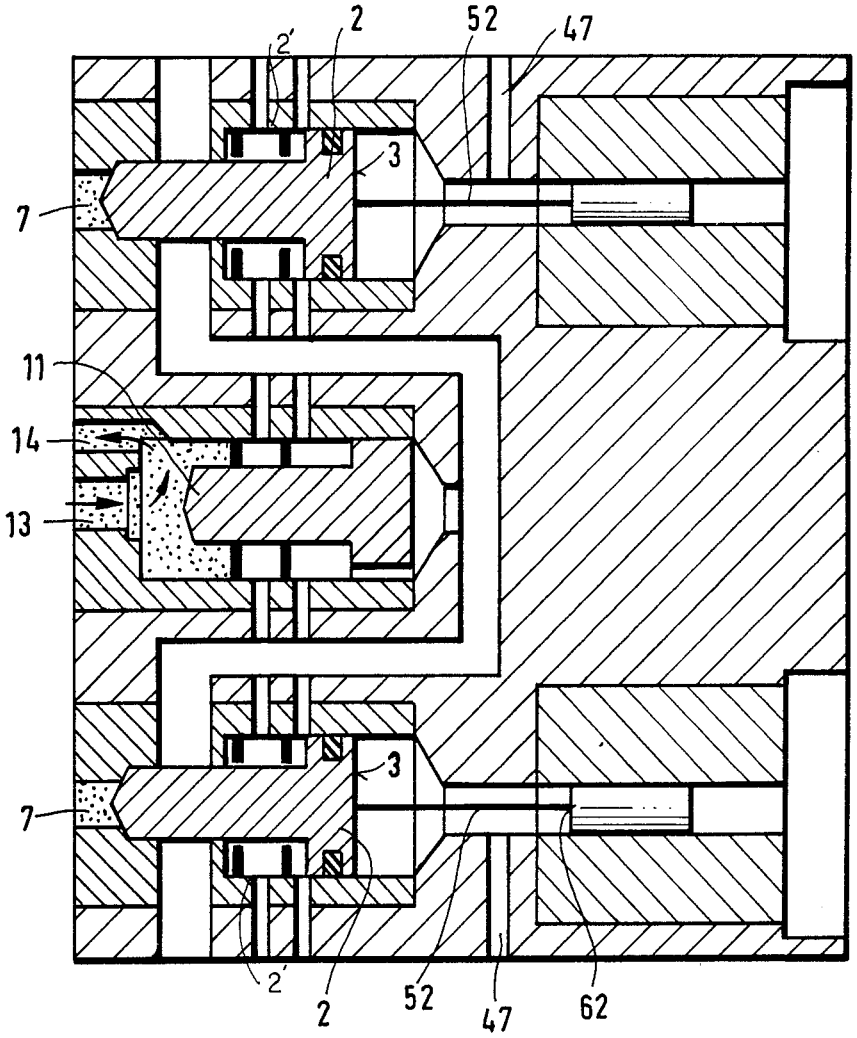
FIG. 9 is an enlarged view of FIG. 6 wherein the gas streaming direction of the generator gases during the straight flight with electromagnetically closed control members is illustrated.

This thrust impulse can be effected either only at sealing member 2 during the flight-rotation as illustrated in FIG. 7 or sequentially via a plurality of sealing members 2 as illustrated in FIG. 8 or 9.

A termination of the flight correction is either introduced by adjustment of the conduit valve in the open position 46, whereby the pressure medium 51 can reach via the feed conduit 30 into the control conduit 4 and thereby the sealing member 2, as a result of the pressure loading of the surface 3 thereof, can carry out the blocking movement for blocking the generator gas-feed conduit 7 or the open position 9 of the sealing member 2 is closed directly electromagnetically via the plunger 52 and the switching member 62. The stroke volume of the piston head 15 is discharged via the throttle opening 24 and the conduit 36 so that the surface 12 of the sealing member 11 can be unloaded and the sealing member 11 can open itself by way of the pressure of the generator gases in the generator gas-feed conduit 13. The generator gas is directly discharged via the discharge conduit 14 in the direction of the arrow when the sealing member 11 is opened.

In all of the afore-descibed embodiments the sealing members 2, 11 are slidably mounted in mating bores 2', 11' in the steering block 1.

In the foregoing description of the transverse thrust steering arrangement there is advantageously indicated that, in contradistinction to the oscillating steering arrangements of the prior art, by avoiding the losses due to secondary streams, there are formed equally strong control impulses by means of the full stroke utilization of the coaxially arranged sealing members, as is required for flight correction of flight-stabilized projectiles.

Moreover, the claimed features are described as being capable of achieving their objects by simple means whereby the selected steering method (electromagnetic-pneumatic or electromagnetic-mechanical in an uncomplicated, and malfunction-free manner; the inventive arrangements have been found in practice to be quite load resistant.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

I claim:

1. An improved autonomous steering system for a fin-stabilized projectile having a gas generator which emits gases for steering the projectile by means of gas thrusts transversely with respect to the longitudinal axis of the projectile, and including a steering block having at least a pair of parallel bores in each of which a sealing member is slidably movably mounted, a first one of said sealing members being operatively connected to an electrically actuated signal converter means, and a nozzle for emitting a transverse thrust with respect to the longitudinal axis of the projectile being in fluid communication with the bore in which said first one of said sealing member is slidably mounted, the improvement comprising said bore with which said nozzle is in fluid communication and in which said first one sealing member is slidably mounted is disposed parallel to the longitudinal axis of said projectile in said steering block and is connected to said signal converter means via a separate signal carrier, whereas said bore in which the other second sealing member is slidably movably mounted is in fluid communication with said gas generator via a first gas conduit and includes a gas draw-off passage and is coaxially disposed with respect to the longitudinal axis of the projectile.

2. The improved autonomous steering system as set forth in claim 1, wherein said first and second sealing members are functioning as differential pistons having first and second end faces which are respectively defined by first and second cylindrical portions having diameters respectively mating with said parallel and coaxial bores; said first and second sealing members including respectively third and fourth cylindrical portions of smaller diameter than said first and second cylindrical portions; and first and second annular shoulders and third and fourth end faces defining respectively opposite ends of said third and fourth cylindrical portions; generator gas producing means being adapted to conduct pressurized generator gas via a generator gas conduit to said parallel bores in which said first sealing members are slidably mounted; said first sealing members being adapted to axially move between an open and closed position so as to block or unblock communication between said parallel bores and said transverse thrust nozzle; said third and fourth end faces having seating surfaces adapted to respectively coact with first and second valve seats; said first and second valve seats being respectively formed at the inner ends of first and second generator gas feed conduits forming part of said gas conduit; said first cylindrical portion of said first sealing member having sealing ring means operatively mounted thereon.

3. The improved autonomous steering system as set forth in claim 2, wherein said valve seats respectively formed at the inner ends of said first and second generator gas feed conduits are axially arranged with respect to the direction of flight of the projectile so that the seating surfaces of the third and fourth end faces are respectively biased against the corresponding first and second valve seats as a result of the inertial forces effected by the mass moments of inertia of the first and second sealing members during the initial flight phase of the projectile.

4. The improved autonomous steering system as set forth in claim 3, wherein the first cylindrical portion of the first sealing members define said first end faces; cold air transmitting means operatively connected to said signal converter so that when said signal converter is selectively energized it biases or pressure-releases a corresponding first end face of a preselected first sealing member via said cold air transmitting means.

5. The improved autonomous steering system as set forth in claim 4, including signal receiving means operatively connected to said signal converter, said signal receiving means including plunger means for controlling said pressure medium transmitting means to thereby control the biasing of said first end face of said first sealing member.

6. The improved autonomous steering system as set forth in claim 5, wherein said signal converter includes electromagnet means operatively connected with said plunger means, said first bore having a third gas feed conduit for housing said first end faces of said first sealing members; valve means operatively connected to said plunger means and adapted to selectively block or unblock the passage of gas through said third gas feed conduit and correspondingly vent or block venting to the atmosphere of gas; whereby when no control signal is received by said signal converter said third gas feed conduit is unblocked and valve means venting is blocked by said valve means, and when a control signal is received by said signal converter said third gas feed conduit is blocked and valve means venting is unblocked by said valve means.

7. The improved autonomous steering system as set forth in claim 6, wherein said plunger includes a plunger which is coaxially directly connected to the first end face of said first sealing member, and spring means connected to said plunger for biasing said first sealing member into said closed position, said first sealing member being moved to said open position by said plunger when said signal converter is energized.

8. The improved autonomous steering system as set forth in claim 7, wherein the cross-sections of the transverse nozzle means, said first and second generator gas feed conduits and said vent conduit are circular.

9. The improved autonomous steering system as set forth in claim 8, wherein said transverse nozzle means is radially disposed relative to said first generator gas feed conduit and relative to the axis of said steering block.

10. The improved autonomous steering system as set forth in claim 9, wherein in the case of a plurality of first sealing members said transverse nozzle means are disposed in a plane which is normal with respect to the axis of said steering block.

11. The improved autonomous steering system as set forth in claim 10, wherein the stroke volumes respectively formed by the differential piston surfaces of said first and second annular shoulder and said first and second end faces of the first and second cylindrical portion of the first and second sealing members are ventable in a pressure-less manner via venting passages to the atmosphere.

12. The improved autonomous steering system as set forth in claim 11, including sealing ring means operatively mounted in said first and second bores, the drag-volume produced by the respective movements of said first and second sealing members in said first and second bores being ventable in a pressure-less manner via said venting passages to the atmosphere.

13. The improved autonomous steering system as set forth in claim 2, wherein the inlets of said first and second generator gas feed conduit and the outlet of said vent conduit are disposed in an end face of said steering block and are facing in a direction opposite to the flight direction of the projectile.

14. The improved autonomous steering system as set forth in claim 1, wherein four parallel bores are dispbsed equiangularly about a circle which is centered on the longitudinal axis of the projectile and second fluid conduit means fluidly communicate said coaxial bore with each one of said four parallel bores for selectively actuating each first sealing member slidably mounted in each parallel bore; each one of said first sealing members in said parallel bores being operatively electrically connected to said signal converter means, said signal converter means being constructed so that one signal converter is electrically connected to each first sealing member in each parallel bore so that when a steering signal is emitted from the steering system of the projectile it is transmitted via the input of a preselected signal converter.

* * * * *